United States Patent [19]

Yalkowsky

[11] 4,056,340

[45] Nov. 1, 1977

[54] PRILLING APPARATUS

[75] Inventor: Samuel H. Yalkowsky, Portage, Mich.

[73] Assignee: The Upjohn Company, Kalamazoo, Mich.

[21] Appl. No.: 701,892

[22] Filed: July 1, 1976

[51] Int. Cl.[2] ..... B22D 23/08

[52] U.S. Cl. ..... 425/10; 425/143; 425/145; 425/159; 264/13

[58] Field of Search ..... 425/6, 8, 10, 143, 145, 425/135, 155, 159; 264/6, 13; 222/146 HE

[56] References Cited

U.S. PATENT DOCUMENTS

| | | | |
|---|---|---|---|
| 1,393,383 | 10/1921 | Linebarge | 264/13 |
| 1,534,729 | 4/1925 | Obersohn | 264/13 |
| 1,762,693 | 6/1930 | Linebarge | 425/6 X |
| 2,038,251 | 4/1936 | Vogt | 425/6 X |
| 2,712,621 | 7/1955 | North | 425/6 X |
| 3,092,553 | 6/1963 | Fisher, Jr. et al. | 425/6 X |
| 3,123,855 | 3/1964 | Fischer et al. | 425/6 |
| 3,143,475 | 8/1964 | Koff et al. | 264/13 X |
| 3,231,641 | 1/1966 | Edmunds | 264/13 |
| 3,242,237 | 3/1966 | Belak et al. | 264/13 |
| 3,437,488 | 4/1969 | Humphreys | 425/10 X |
| 3,457,335 | 7/1969 | Elliott | 264/13 |
| 3,570,725 | 3/1971 | Baker et al. | 222/50 K |
| 3,744,983 | 7/1973 | Jenkins | 425/6 X |
| 3,815,788 | 6/1974 | Reighand et al. | 222/146 HE |
| 3,827,603 | 8/1974 | Reighand et al. | 222/145 HE |
| 3,990,820 | 11/1976 | Danguillier et al. | 425/10 |

FOREIGN PATENT DOCUMENTS

| | | | |
|---|---|---|---|
| 1,007,471 | 3/1957 | Germany | 425/6 |

*Primary Examiner*—Robert L. Spicer, Jr.
*Attorney, Agent, or Firm*—Blanchard, Flynn, Thiel, Boutell & Tanis

[57] ABSTRACT

A process and apparatus for prilling pharmaceuticals and the like. A mixture supply device provides a melted mixture of a pharmaceutical and a vehicle at a preselected pressure and at a temperature less than the decomposition temperature of the pharmaceutical, such vehicle being solid at normal room temperature. One or more guns receive the melted mixture. A pulse generator provides a train of pulses of preselected frequency and width which through a transducer causes a valve in each gun to periodically open at a frequency and for a duration controlled by the pulse frequency and width. Each gun has a nozzle supplying melted material upon opening of the corresponding valve and from which is ejected a series of spaced droplets of melt mixture at the pulse frequency, which droplets are of size controlled by the pulse width. Means below the nozzle define a gravity drop path for the droplets and contain a fluid for congealing the droplets as they fall along such path to form same into substantially spherical prills.

13 Claims, 5 Drawing Figures

PRILLING APPARATUS

FIELD OF THE INVENTION

This invention relates to a method and apparatus for prilling and more particularly relates to such a method and apparatus capable of producing uniform pharmaceutical prills at a high rate in a minimal space.

BACKGROUND OF THE INVENTION

While it is contemplated that the method and apparatus of the present invention may be used for prilling of substances other than pharmaceutical mixtures, the present invention arose from a need for packaging of pharmaceuticals in small particles. Thus, by way of example, the present invention will be described in connection with production of pharmaceutical prills.

Many drugs are known to upset the stomach or be inactivated by acidic gastric contents. To be given orally, such drugs must be enteric coated. Due, for example to the randomness of stomach emptying, provision of such a coated drug as a large number of individual coated particles improves the uniformity of drug release than would provision of the same dosage in a single tablet or capsule.

The present applicant is aware of multi-particulate dosage forms, such as micropellets, medules, spansules and others. Both are generally satisfactory but have drawbacks. Micropellets have a cylindrical shape which is difficult to coat. Medules, spansules, etc. have not been found suitable for high drug dosages. All forms are relatively expensive to produce.

A process known as prilling has been used in various industries to produce small particles. Classically, prilling consists of melting a material, allowing it to fall in a narrow stream through an orifice, permitting the stream to break up as it falls into discrete droplets and then permitting the droplets to congeal as they fall further.

For example, urea prills have been produced for fertilizer in large amounts at low cost in commercial prilling towers.

These towers are generally in excess of 300 feet high to permit sufficient cooling time to congeal the prills.

However, such a prilling arrangement was unsatisfactory for the pharmaceutical task at hand, for example in view of the great height of such a conventional prilling tower, which substantially exceeds the height limitations in conventional pharmaceutical plant buildings and would be costly to construct. Further, this prior prilling process disadvantageously would require substantial tower diameter in view of the tendency of the forming prills to spread laterally as they fall. Moreover, such prior prilling systems have yielded prills which vary substantially in diameter, resulting in the need for screening of prills and either recycling or loss of under- and oversized prills. Additionally, the use of such very large prior prilling towels to handle pharmaceuticals, in view of the potency of the raw drug, possible irritation of plant personnel which could be caused by handling of sophisticated pharmaceuticals and chemicals, and the overall safety of the process, would produce substantial problems.

An attempt was made to overcome the problems of such conventional prilling techniques by use of a modified prilling head wherein molten prill mix was forced out of a nozzle in a steady stream, such stream being intersected after leaving the nozzle by three converging streams of air which compress the prill mix stream and then break it up into a shower of droplets. While this reduced the fall height required to solidify the prills, it had major disadvantages, including a highly nonhomogenous particle size range and a wide area distribution of finished particles (requiring that such particles be collected from, for example a 24-square-foot area).

Other known methods for forming small spherical pellets of the type desired were found to have one or more disadvantages rendering same unacceptable for the intended use.

During the development of the present invention it was determined that a proper vehicle for the drug must be found, it usually being nonfeasible to melt the drug directly. Requirements for the vehicle included low cost, capability to melt at reasonably low temperature, and capability to act as a good solvent for the drug such that the molten vehicle can dissolve the drug without decomposition of the latter. On the other hand, the vehicle melt temperature cannot be too low or same will not congeal into prills. Once congealed, it must be hard enough to be handled by sizing and coating equipment. Also, such vehicle must be compatible with coating materials for the resultant particles and must dissolve easily in water. Finally, it was determined that such vehicle must be safe for internal use. As hereinafter discussed, such vehicle was found.

The objects and purposes of the present invention include provision of:

1. A method and apparatus for prilling, particularly of pharmaceutical materials, allowing formation of substantially spherical particles in large quantity per unit time and at low cost.

2. A method and apparatus, as aforesaid, capable of forming uniformly sized prills within a relatively short and small diameter drop zone from which solidified prills can be readily gathered and wherein the coolant fluid in the drop zone may be a liquid or gas, such as air.

3. A method and apparatus, as aforesaid, in which prill size and rate of production are precisely controlled by a voltage wave form, wherein the pressure and temperature of the prill mix are precisely controllable, and wherein the apparatus can be constructed largely from readily available commercial parts at low cost.

4. A method and apparatus, as aforesaid, in which dropping of a stream of molten prill material is eliminated and the apparatus includes one or more reciprocable valve members which admit the molten prill material to the coolant fluid in the form of initially separated droplets.

5. A method and apparatus, as aforesaid, capable of forming enteric coatable prills suitable for use in multiparticulate dosages.

6. A method and apparatus, as aforesaid, capable of employing an inexpensive vehicle for the drug to be prilled, which vehicle is capable of melting at a relatively low temperature and is capable of acting as a good solvent for drugs of interest without effecting decomposition of such drug, which is capable of congealing under room temperature conditions and upon congealing is sufficiently hard to be handled by conventional sizing and coating equipment, which is compatible with conventional coating materials and dissolves easily in water and which is safe for internal use.

7. A method and apparatus, as aforesaid, wherein one or more hot melt glue guns are adapted to separate melted pharmaceutical prill mixture into a series of droplets of closely controlled size and frequency before dropping through a cooling fluid.

Other objects and purposes of the invention will be apparent to persons acquainted with apparatus and methods of this general type upon reading the following specification and inspecting the accompanying drawings.

SUMMARY OF THE INVENTION

The objects and purposes of the invention are met by providing a process and apparatus for prilling pharmaceuticals and the like. A mixture supply device provides a melted mixture of a pharmaceutical and a vehicle at a preselected pressure and at a temperature less than the decomposition temperature of the pharmaceutical, such vehicle being solid at normal room temperature. One or more guns receive the melted mixture. A pulse generator provides a train of pulses of preselected frequency and width which through a transducer causes a valve in each gun to periodically open at a frequency and for a duration controlled by the pulse frequency and width. Each gun has a nozzle supplying melted material upon opening of the corresponding valve and from which is ejected a series of spaced droplets of melt mixture at the pulse frequency, which droplets are of size controlled by the pulse width. Means below the nozzle define a gravity drop path for the droplets and contain a fluid for congealing the droplets as they fall along such path to form same into substantially spherical prills.

DETAILED DESCRIPTION

Figure 1:
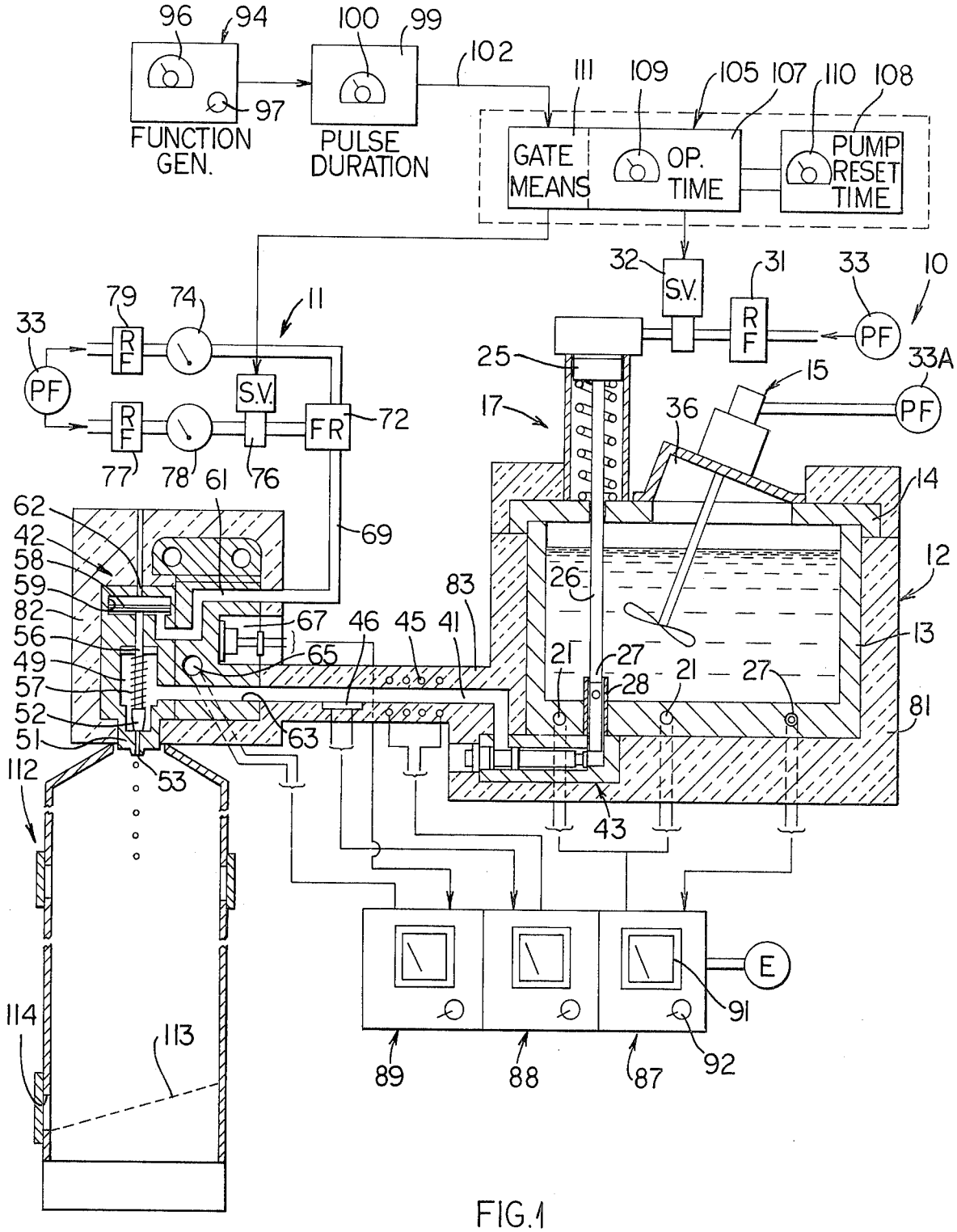
FIG. 1 is a substantially diagrammatic view of a prilling apparatus embodying the invention.

FIG. 1 discloses a prilling apparatus 10 embodying the invention. Same includes a tank unit 12 for receiving the pharmaceutical prilling mixture. The tank unit 12 includes a tank 13 having a removable cover 14 supporting a motor driven stirrer 15 and a pump 17.

Suitable heating means, such as electric resistance heating elements 21, here shown as being contained within the wall thickness of the tank 13, are actuable to maintain the contents of tank 13 at a desired temperature and in a molten condition. The tank 13 is preferably also thermostated at 22 to indicate the existing temperature of the tank 13 and hence permit accurate control thereof.

The pump 17 may be of any desired kind, but in the particular embodiment shown, may be similar to that disclosed in U.S. Pat. No. 3,815,788 of Reighard et al and assigned to Nordson Corporation of Amherst, Ohio. Such a pump may be characterized as a single-acting sleeve-type air motor driven piston pump wherein compressed air applied to the top of piston 25 downwardly drives the attached piston rod 26. The bottom end 27 of the piston rod 26 coacts with a perforated sleeve 28 open to the bottom portion of tank 13, for forcibly urging a quantity of the melt mixture in tank 13 out through sleeve 28. Air under pressure may be applied to the pump 17 in any convenient way, here including a regulator-filter unit 31 and a solenoid valve 32 connecting a conventional compressed air source 33 to a pump air chamber atop piston 25. The pump 17 is capable of transferring molten prill material out of the tank 13 at a desired pressure, as hereinafter discussed. It will be recognized, however, that pumps of various types may be used for transferring the molten prill material from the tank 13, including, for example, continuous run types, as opposed to discontinuous types as exemplified by the particular pump 17 shown.

The stirrer 15 may be of any desired type but here is air driven from a conventional compressed air source generally indicated at 33A.

The prilling mixture may be admitted to the tank 13 by removal of cover 14, or more conveniently, removal of a portion thereof such as stirrer support 36 or it can be pumped in from a pre-melt tank (not shown).

The outlet portion 28 of pump 17 connects through a conduit 41 to a droplet forming gun 42. The conduit 41 may include, for example, as in aforementioned Nordson U.S. Pat. No. 3,815,788, a subassembly 43 including a filter, check valve and relief valve, for controlling the flow of molten material to the gun 42.

The conduit 41, intermediate its ends, is preferably also provided with suitable heating means, here in the form of an electric resistance heating coil 45, and also with a heat sensing element 46 such as a thermistor or other thermostatic element having an electrical output. In this manner, melt mixture within the conduit 41 can be maintained at the proper temperature such that it retains its molten quality but is not subjected to heat degradation.

The outlet end of conduit 41 connects to the molten material inlet of gun 42.

The gun 42 in a preferred embodiment of the invention was generally of the type shown in U.S. Pat. No. 3,570,725 of Baker et al, assigned to Nordson Corporation of Amherst, Ohio, and, more particularly, was based on the Nordson Model H-20 Hot Melt Glue or Adhesive Gun.

In the particular embodiment shown, the gun 42 includes a melt chamber 49 open to said melt conduit 41. A nozzle 51 is fixed (preferably threadedly and removably) to the body 52 of the gun 42 and opens downwardly from the bottom of melt chamber 49, such that melt mixture in chamber 49 can flow downwardly through the central opening 53 of nozzle 51.

A valve member 55 carried on the lower end of a plunger 56 is vertically reciprocable in the melt chamber 49 so as to alternatively open or close communication between the melt chamber 49 and the upper end of nozzle opending 53. A spring 57 urges the valve member 55 downwardly to close the nozzle 51. A piston 58 is fixed to the plunger 56 adjacent its upper end and is reciprocable in a chamber 59 in gun body 52. The gun body 52 contains an air passsage 61 communicating with the underside of piston 58 for lifting valve member 55 away from nozzle 51 such that a quantity of melt mixture in the gun chamber 49 can escape downwardly through nozzle opening 53. To permit such upward actuation of the plunger 56, the upper end of chamber 59 is vented at 62.

Disposed in the gun body 52 adjacent the melt mixture chamber 49 and the passage 63 connecting same to melt mixture conduit 41, is a heating element 65, preferably a conventional electric resistance heating element. A conventional temperature sensing element 67, such as a thermostatic element or similar device for providing an electrical output in response to temperature variation, is carried by the gun body for monitoring the temperature of melt mixture therein.

An air supply conduit 69 connects a pressurized air supply system 71 to the air passage 63 in gun body 52. In the embodiment shown, the pressurized air supply system comprises an air operated relay valve 72 which when opened supplies conduit 69 from a suitable source of air under pressure, as above mentioned source 33, through a conventional regulator and filter device 73 and if desired a pressure indicator 74. The relay 72 is normally in a closed, or off, condition but has a control input connected through a solenoid valve 76, and if desired a series pressure regulator-filter device 77 and pressure indicator 78 to the mentioned source of air under pressure 33. Thus, actuation of the solenoid valve 76 permits air flow through the patch 33, 77, 78, to the control input of air relay 72, causing same to connect the air supply through the path 73, 74 to the gun air input conduit 69.

The tank unit 12, gun 42 and the inner connecting conduit 41, along with the heating and temperature sensing elements 21, 22, 45, 46, 65 and 67 associated therewith, are surrounded by suitable insulation generally indicated at 81, 82 and 83 to assist the heating and temperature sensing element in maintaining the melt mixture at the proper temperature.

Adjustable temperature controls 87, 88 and 89 have respective electrical inputs from the temperture sensors 22, 46, and 67 and provide electric heating current flow to the resistance heaters 21, 45, and 65, respectively. Each such temperature control provides a temperature read-out meter 91 from which the temperature of the corresponding one of the tank 13, conduit 41 and gun 42 may be read. Each such adjustable temperature control further includes a manual adjustment knob 92 actuable for setting the desired temperature of the corresponding one of the units 12, 41 and 42. Operating potential is applied to the controls 87–89 in any convenient manner as from a suitable electric source 34. The control 87–89 may be of any conventional type, and in the embodiment shown were manufactured by API Instruments and were furnished by Nordson Corporation located at Amherst, Ohio.

Figure 2:
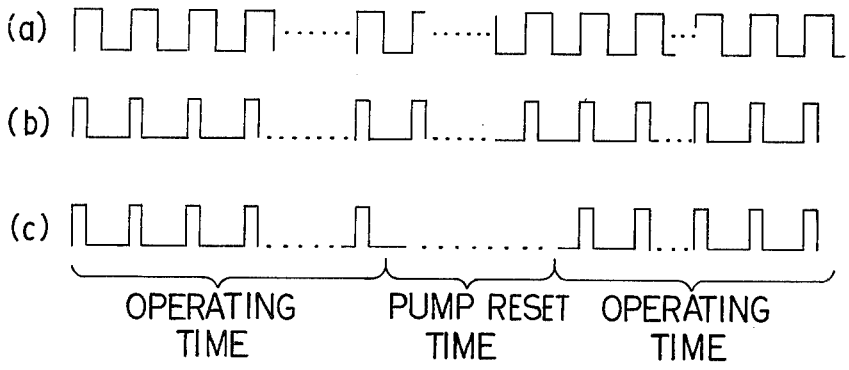
FIG. 2 discloses wave forms produced by portions of the apparatus of FIG. 1.

Turning now to the control of the solenoid valves 32 and 76, a function generator 94 provides a square wave output as seen at FIG. 2, wave form "*a*". The function generator 94 includes suitable indicating controls 96 and 97 to set the frequency and amplitude, respectively, of the square wave voltage output therefrom. An example of such a square wave generator is a Model No. 3311A Function Generator manufactured by Hewlett-Packard located at Palo Alto, Calif. The square wave voltage output of function generator 94 is applied to a variable length pulse duration circuit 99 adjustable by a manual control 100 to set the length of the pulses in the square wave train from generator 94, producing a controlled pulse duration train indicated for example at FIG. 2*b*, which appears on line 102. The pulse duration circuit may be of any convenient type, such as the Model No. C 2 Time Interval Control manufactured by Nordson Corporation located at Amherst, Ohio.

Where, as in the embodiment above discussed, a resettable rather than continuous output melt pump is employed at 17, the prilling apparatus 10 further includes a pump control timer diagrammatically indicated at 105. Timer 105 includes pump operating and pump reset timing portions 107 and 108 each manually adjustable as to time by means of suitable controls 109 and 110. For example, pump reset timer 108 times an interval of 30 seconds duration during which solenoid valve 32 is held off permitting spring return of plunger 26 of pump 17. During this time operation timer 107 is reset and a gate or switch 112 in line 102 blocks the square wave signal in such line preventing application thereof to solenoid valve 76. Upon completion of such pump reset time, timer 108 triggers operating timer 107 to time an operating interval (e.g. 2 minutes) during which time timer 107 actuates gate means 112 and solenoid valve 32 to respectively apply the square wave form on line 102 to solenoid valve 76 and to apply air pressure to the top of piston 25 of pump 17. Under such condition, the pump 17 forces heated melt mixture from tank 13 through conduit 41 into the melt chamber of gun 42 while cyclically operated solenoid valve 76 periodically opens valve 55 at the frequency determined by function generator 94 and for the duration determined by pulse duration circuit 99. The pump control timer 105 may be of any convenient type and, in this case, was furnished by Nordson Corporation.

Where the melt mixture pump employed is a continuous run type, the pump timer 105 can be eliminated with manual controls substituted for energizing solenoid valve 32 and pulse duration circuit 99 direct connected through line 102 to solenoid valve 76.

Disposed immediately below and adjacent the nozzle 51 of gun 42 is a prilling tower 112. By providing a tower in the range of 25–35 feet in height, prilling entirely by air drop can normally be achieved with the gun 42 above described. The tower 112 may be provided, if desired, with a screenlike sloped surface 113 upon which the formed and hardened prills fall and from which same may be withdrawn from the tower 112, as through a port 114. On the other hand, and as diagrammatically indicated in FIG. 5, droplets from the nozzle 51 of gun 42 may drop through a short air space, as of ½ to 2 inches as indicated at 116, and then be received in a cooling liquid bath 118 of a few feet of less depth, as hereafter discussed.

OPERATION

As to the method or operation by which prills are formed in accord with the present invention, attention is directed to FIG. 1. Since it is usually not feasible to melt the drug or pharmaceutical to be prilled in a direct manner, a vehicle is provided. The vehicle must, for example, have a melting point which does not exceed the decomposition point of the pharmaceutical and the vehicle should solidify at a convenient temperature, e.g. desirably as a solid at normal room temperature. Other vehicle requirements are discussed hereafter.

The vehicle is melted and the pharmaceutical to be prilled is dissolved or dispersed in the melted vehicle to the desired concentration. Such may be done within the tank 13, or if separately therefrom, the pharmaceutical dispersed in the melted vehicle may be placed in tank 13. While the illustrated FIG. 1 apparatus does not show same, it is contemplated that the tank 13 may be continuously fed from outside source with a mixture of the melted vehicle and pharmaceutical. Stirrer 15 rotates continuously to maintain a uniform circulation of the melt mixture in the tank 13.

Heating elements 21, under the control of the adjustable temperature control 87, maintain the temperature of the melt mixture bath in tank 13 at the desired temperature set manually by means of knob 92.

Where, as shown in FIG. 1, a refillable melt mixture pump 17 is employed, the pump timer schematically shown at 105 sets the pump operating and reset times, for example at 2 minutes and 30 seconds, respectively. During reset, pump timer 105 turns off solenoid valve 32. Air pressure is thus moved from the top of pump piston 25, permitting spring return of piston rod 26 to its upper position shown wherein melt mixture flows into pump tube 28 through the opening shown to fill same. Upon termination of the reset time, pump timer 105 activates solenoid valve 32 which then applies air pressure from source 33 to the top of piston 25 driving the piston rod 26 progressively downwardly such that the bottom of piston rod 26 drives the melt mixture through the conduit 41 to the gun 42. Depending on the volume of the pump 17 relative to the passages 28 and 41 and the melt mixture chamber 49 and gun 42, several cycles of the melt mixture pump may be required to initially load gun chamber 49. During such loading and subsequent operation, the conduit 41 and melt mixture receiving portions of gun 42 are maintained at proper operating temperature by means of respective heaters 45 and 65, thermostatic pickups 46 and 67, and adjustable temperature controls 88 and 89. Control 89 maintains gun 42 at a temperature such that the temperature of melt mixture leaving the nozzle 51 will be at a temperature immediately above its solidification temperature, at least within 5° and preferably within 1°.

Provision of separate adjustable controls 87 and 88 upstream from the gun 42 permit the contents of conduit 41 and tank 13 to be maintained, if desired, at a somewhat higher temperature than the melt mixture in the gun, as to enhance flowability of the melt mixture to the gun and minimize any tendency for isolated portions of the melt mixture in the tank or conduit to cool and solidify prematurely.

With the chamber 49 of gun 42 fully charged with melt mixture at proper temperature as monitored by the readout meter of control 89, and with pump 17 supplying a constant pressure on the melt mixture material, the function generator 94 and pulse duration circuit 99 may be started. The square wave form (FIG. 2*a*) from function generator 94 with pulse duration set by pulse duration circuit 99 (FIG. 2*b*) passes through line 102 and the pump timer gate means 112 to solenoid valve 76. The latter triggers air relay 72 for the duration of each such pulse occurring during the operating time of pump timer 105, the gate means 112 precluding such actuation of solenoid valve 76 and air relay 72 during the pump reset time, as generally indicated in FIG. 2*c.*

The normally closed, or downwardly positioned, gun valve 55 rises away from and opens nozzle passage 53 for the duration of the air pulse produced by air relay 72 in response to each electrical pulse applied to the solenoid valve 76. Gun valve 55 is urged downwardly to close the nozzle passage 53 at the end of each said pulse by spring 57. During each opening of gun valve 55, back pressure on the melt mixture in chamber 49 causes a discrete droplet of melt mixture to pass through and fall from the nozzle 51 of the gun. Each such droplet cools to form a spherical prill.

In practice, it has been found that the frequency of operation of gun 42 can be set as high as 3,000 prills per minute. The pressure applied to the melt mixture, the size of the nozzle opening 53, the viscosity of the hot melt mixture and the duration of opening of valve 55 determine the size of the droplet and hence of the prill. With a given nozzle, nozzle size is fixed, and pressure, viscosity (as a function, for example, of temperature) and valve opening duration are all controllable as above discussed. It has been found that with the above-described apparatus operating in the above-described manner, droplet or prill size is readily selectable, and once selected, it is consistent within relatively close limits.

Figure 3:
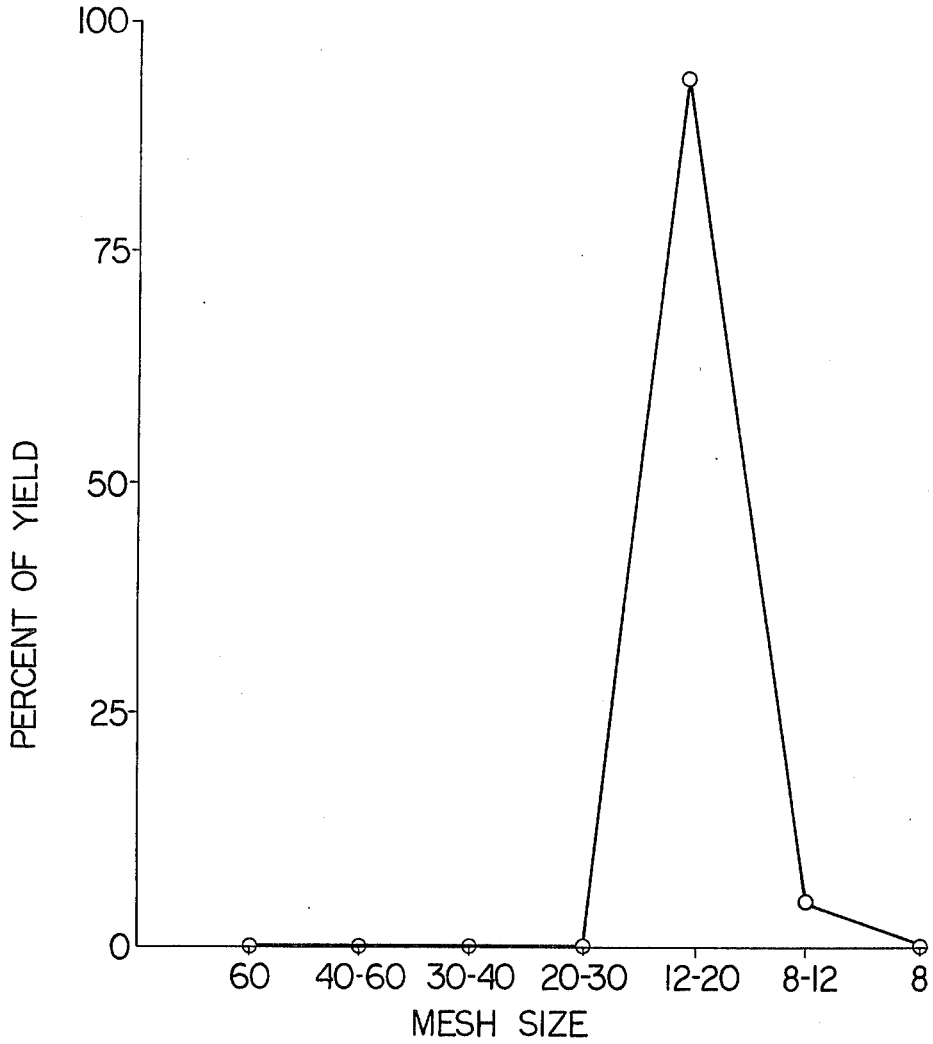
FIG. 3 is a plot indicating the distribution and size of prills produced in accord with the present invention.

As seen in FIG. 3, which summarizes the results of a number of runs with apparatus of the above-described type, all runs of such apparatus gave yields of between 85 and 95 percent of the desired particle size range, in this instance 12–20 mesh. This compares with considerably smaller and much more widely variable yields with apparatus wherein molten material was emitted in a stream from the prilling head and broken up into droplets by convergent airstreams after it left such head.

As a practical matter, it has been found that prills in the range of 12–20 mesh (840 to 1680 microns) are ideally sized for use and manufacture of multi-particulate enteric coated dosage systems. The range is narrow enough that there is little or no size segregation during handling and coating. Sample lots in this size range have been coated with complete success. Coated and uncoated prills of this size range flow well and appear to be suitable for handling by conventional processing equipment.

As droplets leave the gun 42, same can be subjected to a drop through air in tower 112 shown in FIG. 1, to cool and solidify same into solid prills capable of further handling without deformation or damage. Depending on vehicle use, and with gun temperature control such that the droplet is substantially at solidification temperature as it leaves the nozzle 51, and with prills in the preferred size range above mentioned, only a relatively short air drop distance is required to sufficiently solidify the prills for further handling. In some instances and particularly where the tower air was cooled and/or upwardly moved, drop distances could be brought down to 25 to 35 feet.

Figure 5:
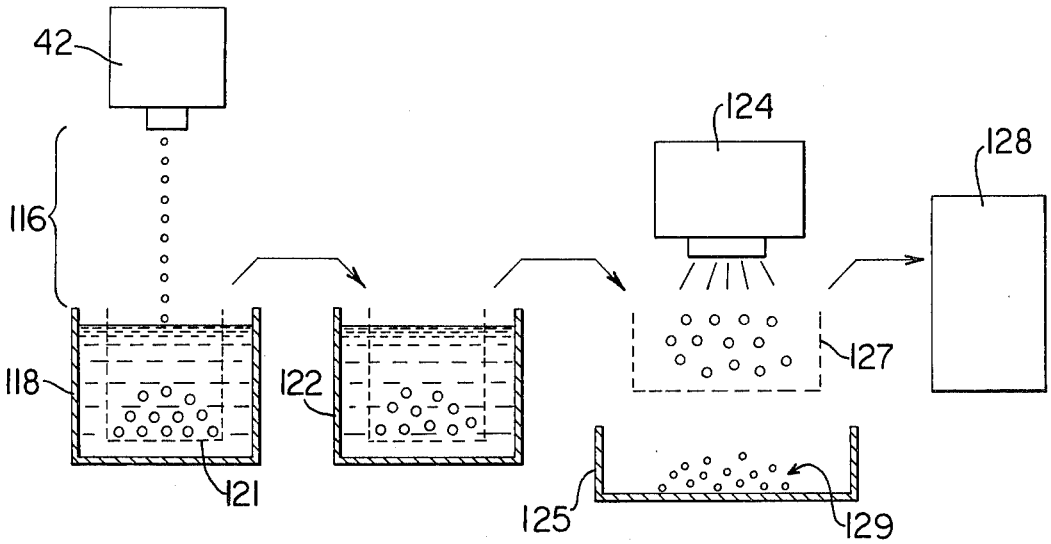
FIG. 5 disloses in diagram form a series of steps involved in an aspect of the present inventive method. de Certain terminology will be used in the following description for convenience in reference only and will not be limiting. The words "up", "down", "right", and "left" will designate directions in the drawings to which reference is made. The words "front" and "rear" will refer to the direction of material flow through the device, "forwardly" being the normal flow direction. The words "in" and "out" will refer to directions toward and away from, respectively, the geometric center of the apparatus and designated parts thereof. Such terminology will include derivatives and words of similar import.

For a more compact gun-tower arrangement, a liquid coolant may be employed as in FIG. 5.

As to the vehicle aspects of the present invention, it has been found that polyethylene glycols in the molecular weight range of between about 4,000 and 6,000 are suitable. Such provides an inexpensive vehicle capable of melting at reasonably low temperature and which is a good solvent capable of dissolving at least some drugs of interest without decomposition. Further, its melting point is sufficiently high that it will congeal at room temperature and once congealed is hard enough to be handled by sizing and coating equipment. Further, it is compatible with cooling materials of interest and dissolves easily in water and is safe for internal use. In particular, polyethylene glycol 6,000 melts at about 56° C. and the molten polymer is a very good solvent from both polar and nonpolar compounds. (It has a Hansch II value of nearly zero.) When congealed, it is very hard and easy to handle and it is highly water soluble and is nontoxic. However other vehicles having suitable physical properties and solvent characteristics may be used.

Several prills formed as above discussed were coated with a cellulose acetate phthalate-di-n-butyl phthalate enteric coating. Coating proceeded without difficulty, indicating compatibility. When used as the vehicle for an insoluble drug, polyethylene glycol was useful in providing rapid dissolution thereof.

Thus, the above-discussed method and apparatus has been used to produce prills containing an active drug. The prills produced were perfectly spherical, easy to handle and coat and dissolved readily in water to release the drug.

In tests, nitrofurantoin was used as a drug, primarily because its yellow color provides a good visual indication of the uniformity of drug dispersal in the polymer vehicle. Prostaglandin $F_2$ alpha has also been successfully used as a drug.

The the present invention has been tested in terms of enteric coated multi-particulate dosage forms, as above discussed, it is also contemplated that utlitity for the present invention would be found in the area of sustained release (coated and uncoated) dosage forms, separation of interacting compounds, handling of dangerous material and incorporation of drugs into animal feeds, as well as in such enteric coated dosage forms.

It may be noted that the prills, even after a 25-foot drop from the gun 42 of FIG. 1, are not as widely scattered as in prior devices such as the air jet device above discussed. Particularly, prills are collected nearly quantitatively in a 2-square-foot area after such a 25-foot drop.

Figure 4:
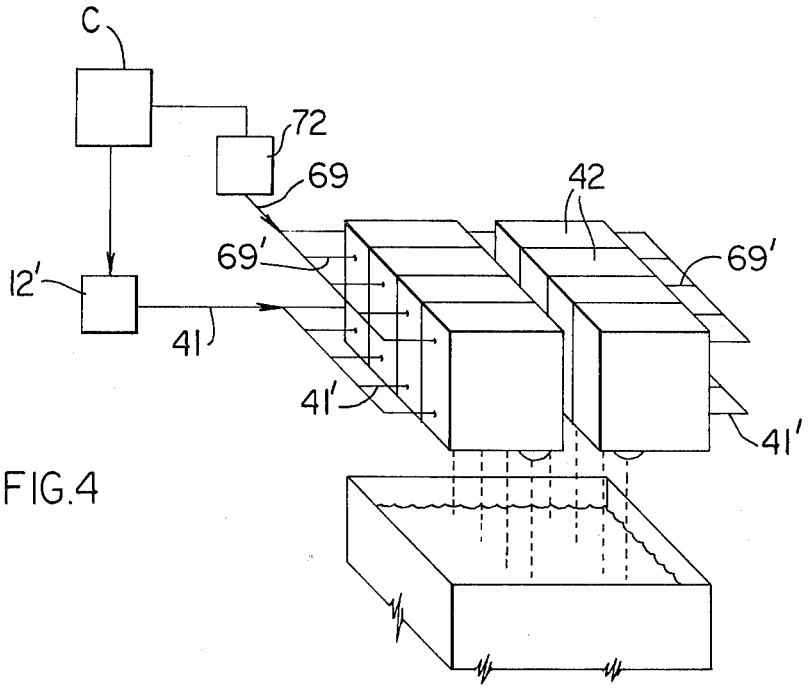
FIG. 4 discloses a multiple gun embodiment of the present invention.

In view of the narrow drop cross section required, it is contemplated that a plurality of guns 42 may be closely arranged side-by-side in a common drop tower or zone as seen in FIG. 4. In FIG. 4, the plural guns are fed melt mixture through plural branch passages 41' of a common melt mixture passage 41 extending from a pump-tank assembly 12' which may be similar to that of FIG. 1. Similarly, operating air pulses are applied through branch air conduits 69' of a common air conduit 69 suitably controlled as by a relay 72 as in FIG. 1. Block C denotes electrical and air control circuitry for the inner relay 72 and pump-tank assembly 12' similar to those components shown in the upper portion of FIG. 1. Thus, with very little additional space required, and primarily with the addition of further guns 42, the capacity of the FIG. 1 system can be substantially multipled as seen in FIG. 4.

The variation shown in FIG. 5 permits a vertically more compact arrangement, the tower 112 being replaced with a short drop (e.g. a foot or less) through air space 116 into a coolant liquid bath 118. In the embodiment shown, the coolant liquid bath contains mineral oil (which because of its viscosity may be relatively shallow, e.g. 4 inches to a foot deep). A screen 121 of appropriate mesh size (e.g. 210 mesh) within the mineral oil bath catches the hardened prills. At the end of a run, a screen is raised and the oil is allowed to drain from the prills back into bath 118. The prills, e.g. still supported on the screen 121, may then be transferred to a further bath 122, e.g. of hexane, to wash the prills free of residual oil. Upon removal from the hexane bath, the prills may be dried, e.g. by moving air propelled by a blower 124, over a catch basin 125. With, or following, this step, under- or oversized prills may be removed by screening as at 127 whereafter acceptable sized prills may be transferred to further processing means 128, e.g. for coating. Under- or oversized prills 129 separated by the screening at 127 may, where practical, be returned to the heated tank 13 of FIG. 1 for reprilling.

Under the present invention, the integration of a hot melt glue gun 42, as above described, into the prilling apparatus, provides a number of advantages, above discussed. A particular advantage, as compared with prior prilling methods above discussed, is that prill size no longer deviates due to changes in atmospheric conditions. More particularly, prill size is determined by conditions at and upstream of nozzle 51 rather than conditions downstream of such nozzle.

In the FIG. 5 system, it is beneficial to impose at least a short airdrop 116 between the nozzle of gun 42 and the liquid bath 118. Such air space provides an insulative interface between the gun nozzle and the liquid bath, enabling the nozzle to be more readily maintained at a temperature above the melting temperature of the prilling mixture, while permitting the liquid bath to be maintained considerably cooler, e.g. signficantly below the solidification temperature of the melt mixture.

As a preferred variation on the FIG. 5 system, it has been found that the mineral oil bath 118 can be eliminated and that the prills of the type mentioned can be air dropped directly into a bath as at 122 of hexane, heptane, Skellysoule® BorC or other inert, nonviscous liquid which can evaporate in air, the inert liquid then being readily removable from the prills by draining or other drying techniques.

It has been found, however, that in a liquid drop sytem such as that of FIG. 5, that the type of catching liquid utilized is critical when spherical prills are desired. Some liquids tested, e.g. methylene chloride, have been found to produce flat rather than spherical prills. It is believed that the melt mixture droplet is stopped momentarily at and by the surface of such liquid, flattened and initially cooled sufficiently as to never regain its spherical shape in dropping further into such liquid. Use of specified drip liquids, such as mineral oil, hexane, heptane, and Skellysol® BorC have avoided this problem.

The present process and apparatus are readily scaled to produce batch volumes or continuous volumes per unit time of prills and may be variable in size. For example, batch sizes as low as 100 grams are readily obtainable.

While the invention has been discussed above in terms of formation of prills for enteric coating, it is also contemplated that a material or materials may be incorporated into the vehicle that would render the vehicle acid insoluble and enteric soluble, examples of such materials including stearic acid, lauric acid, or similar suitable materials. Thus, a subsequent enteric coating of the resultant prills would be unnecessary.

Although particular preferred embodiments of the invention have been discussed in detail for illustrative purposes, it will be recognized that variations or modifications of the disclosed apparatus, including the rearrangement of parts, lie within the scope of the present invention.

I claim:

1. A prilling apparatus for prilling pharmaceuticals and the like, comprising:

means for supplying a melted mixture of a pharmaceutical and a vehicle at a preselected pressure and at a temperature less than the decomposition temperature of the pharmaceutical and wherein the vehicle is a solid at normal room temperature;

gun means including a. a melt chamber connected to said supply means for receiving said melt mixture, b. a substantially downwardly directed nozzle communication with said chamber, c. a valve member and biasing means normally urging said valve member to a closed condition blocking said communication between said chamber and nozzle to prevent melt material flow out of said nozzle, d. shift means actuable for shifting said valve member to an open condition permitting said pressurized melt mixture to escape the gun through said nozzle;

means for generating a train of electrical pulses of preselected frequency and width;

transducer means responsive to said pulse train and coupled to said shift means for periodically opening said valve means at said frequency with a preselected duration controlled by said pulse width and therewith ejecting from said nozzle a series of spaced droplets of melt mixture at said frequency and of size controlled by said pulse width;

container means extending downward below said nozzle and surrounding a gravity drop path for the droplets; and fluid means in said container for congealing said droplets as they fall along said path to form same into substantially spherical prills.

2. The apparatus of claim 1 including temperature control means associated with said gum for maintaining the temperature of melt mixture exiting through said nozzle at a level immediately above the solidification temperature of said vehicle to minimize the drop distance required to congeal the droplets into prills.

3. The apparatus of claim 1 in which said means for supplying melted mixture comprises an insulated tank for receiving the vehicle and pharmaceutical to be carried thereby, electric heating means on said tank for heating its contents, presettable thermostatic means including a temperature sensor on the tank, said thermostatic means being connected to said electric heating means to maintain the mixture within the tank in a melted condition at a temperature less than the decomposition point of said pharmaceutical.

4. The apparatus of claim 3 in which said means supplying a melted mixture further includes an insulated conduit means connecting an outlet of the tank to said melt chamber of said gun means and including further heating means and thermostatic means connected to said conduit for maintaining the temperature of said melt mixture passing therethrough from said tank to said gun.

5. The apparatus of claim 3 in which said means supplying a melted mixture further includes a pump connecting the outlet of said tank to said melt chamber of said gun means for supplying melt mixture at the desired pressure to said gun means, and stirring means in said tank for continuously moving the melt mixture in said tank past said heating means to maintain temperature uniformity in the melt mixture in said tank and avoid both heating of the pharmaceutical past its decomposition point and cooling of the vehicle below its solidification temperature.

6. The apparatus of claim 1 in which said pulse train generating means includes an electronic function generator for generating a square electrical waveform and including means for preselecting the frequency of said waveform, pulse width control circuit means adjustable for carrying the pulse width in said square waveform so as to produce said pulse train of preselected frequency and pulse width.

7. The apparatus of claim 6 in which said transducer means comprises electric valve means normally closing the pressure fluid flow path from a source of working fluid under pressure and said shift means of said gun means and responsive to occurrence of a pulse of said train for opening said flow path substantially for the duration of said pulse, said shift means of said gun means comprising a piston fixed to said valve member and responsive to the pressure fluid pulse from said flow path for holding said valve means open against said biasing means substantially for the duration of said presurre fluid pulse.

8. The apparatus of claim 7 in which said mixture supplying means includes a refillable piston pump, including pressure fluid operated motor means actuable from a pressure fluid source for applying the melt mixture to said gun means at said preselected pressure, and including operation timer means and pump reset timer means corrected for timing alternate operating and pump reset intervals, electrically operated valve means disposed in said pressure fluid path between said pressure fluid source and said pump means and connected to said operating timer means for opening said pressure fluid flow path to operate said pump means during said operating interval, said valve means being closed during said pump reset interval, said transducer means including a further electrically operated valve means interposed in a further pressure fluid flow path between a corresponding pressure fluid source and said shift means of said gun means, said operating timer means including means for connecting the pulse train output of said pulse width control means to said further electrically operated valve means only during said operating interval so as to synchronize operation of said gun means and pump means and preclude gun means operation during resetting of said pump means.

9. The apparatus of claim 1 in which said container means comprises a hollow tower about 30 feet in height and said fluid means is air within the tower, and including means maintaining said air at a temperature below the solidification temperature of said vehicle.

10. The apparatus of claim 1 in which said container means comprises an open topped container, said fluid means including a liquid held in said container, wherein the liquid has a viscosity greater than that of air as to permit said droplets to move slowly downwardly therethrough and congeal before coming to rest on a supporting surface in said container.

11. The apparatus of claim 10 in which said liquid is inert with respect to the vehicle and pharmaceutical, and including a further container having a wash liquid, means for shifting prills from the first-mentioned container to said wash liquid container for washing traces of said viscous liquid therefrom, and means for removing said wash liquid from said prills by drying.

12. The apparatus of claim 11 in which said vehicle is a polyethylene glycol having an average molecular weight between about 4000 and 6000, said viscous liquid is mineral oil, and said wash liquid is hexane.

13. The apparatus of claim 1 in which said gun means is a hot melt glue gun.

* * * * *

UNITED STATES PATENT AND TRADEMARK OFFICE

CERTIFICATE OF CORRECTION

PATENT NO. :4 056 340

DATED 7:7 November 1

INVENTOR(S) : Samuel H. Yalkowsky

It is certified that error appears in the above-identified patent and that said Letters Patent are hereby corrected as shown below:

Column 1, line 57; delete "towels" and replace with ---towers---

Column 3, line 17; delete "de".

Column 5, line 28; delete "patch" and replace with ---path---.

Column 9, line 22; delete "utlitity" and replace with ---utility---.

Column 12, line 3; after "waveform," insert ---said pulse train generating means also including---.

Column 12, line 4; delete "carrying" and replace with ---varying---.

Column 12, line 19; delete "7" and replace with ---6---.

Column 12, line 25; delete "corrected" and replace with ---connected---.

Column 12, line 29; delete "operating" and replace with ---operation---.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademark*